US006973753B2

(12) United States Patent
Liebscher

(10) Patent No.: US 6,973,753 B2
(45) Date of Patent: Dec. 13, 2005

(54) SLIDING DOOR SYSTEM

(75) Inventor: Arne Liebscher, Herdecke (DE)

(73) Assignee: Dorma GmbH + Co. KG, Ennepetal (DE)

( * ) Notice: Subject to any disclaimer, the term of this patent is extended or adjusted under 35 U.S.C. 154(b) by 72 days.

(21) Appl. No.: 10/413,025

(22) Filed: Apr. 14, 2003

(65) Prior Publication Data

US 2004/0107642 A1 Jun. 10, 2004

(30) Foreign Application Priority Data

Apr. 16, 2002 (DE) ..... 102 16 983

(51) Int. Cl.[7] ..... E06B 7/28

(52) U.S. Cl. ..... 49/308; 49/141; 49/303; 49/260; 49/360

(58) Field of Search ..... 49/141, 303, 306, 49/307, 308, 158, 260, 360

(56) References Cited

U.S. PATENT DOCUMENTS

| | | | | |
|---|---|---|---|---|
| 2,788,097 A | | 4/1957 | Frick | |
| 4,063,388 A | * | 12/1977 | Little | 49/363 |
| 4,290,368 A | * | 9/1981 | Mazzini | 105/341 |
| 4,305,227 A | * | 12/1981 | Georgelin | 49/141 |
| 4,503,637 A | * | 3/1985 | Parente | 49/141 |
| 4,633,616 A | | 1/1987 | Giguere | |
| 4,716,683 A | | 1/1988 | Minter | |
| 4,823,509 A | * | 4/1989 | Ando | 49/303 |
| 5,247,763 A | * | 9/1993 | Hein | 49/31 |
| 6,389,763 B1 | | 5/2002 | Clauss | |
| 2004/0010973 A1 | * | 1/2004 | Lio et al. | 49/306 |

FOREIGN PATENT DOCUMENTS

| | | |
|---|---|---|
| DE | 27 02 031 A1 | 7/1978 |
| DE | 27 58 824 A1 | 7/1979 |
| DE | 33 26 218 A1 | 1/1985 |
| DE | 35 26 720 C2 | 1/1986 |
| DE | 37 11 830 A1 | 10/1988 |
| DE | 93 18 973.7 U1 | 3/1994 |
| DE | 197 53 132 A1 | 6/1999 |
| DE | 100 55 214 C1 | 2/2002 |
| EP | 0 016 957 A1 | 10/1980 |
| EP | 0 551 961 A1 | 7/1993 |
| EP | 0 798 441 A2 | 10/1997 |
| EP | 0 918 130 A1 | 11/1997 |
| FR | 2 534 622 A1 | 4/1984 |
| FR | 2 598 174 A1 | 11/1987 |
| WO | WO 94/06991 | 3/1994 |

OTHER PUBLICATIONS

European Search Report dated Apr. 4, 2005.

* cited by examiner

*Primary Examiner*—Jerry Redman
(74) *Attorney, Agent, or Firm*—Cohen, Pontani, Lieberman & Pavane

(57) ABSTRACT

The invention pertains to a sliding door system with at least one automatically driven sliding leaf, which is guided on a traveling carriage and a support profile, where the drive and a runway rail are mounted in a housing above the sliding leaf, and where the sliding leaf can be swung open if necessary in the outward direction around a vertical axis. To create a sliding door system which ensures a reliable and effective sealing function, especially with respect to smoke and fire, which is suitable for use in escape and rescue routes, and which can be used anywhere, regardless of the structural conditions, the sliding leaf, when in the closed position, has sealing-devices, which are active at all times, on all horizontal and vertical edges.

19 Claims, 11 Drawing Sheets

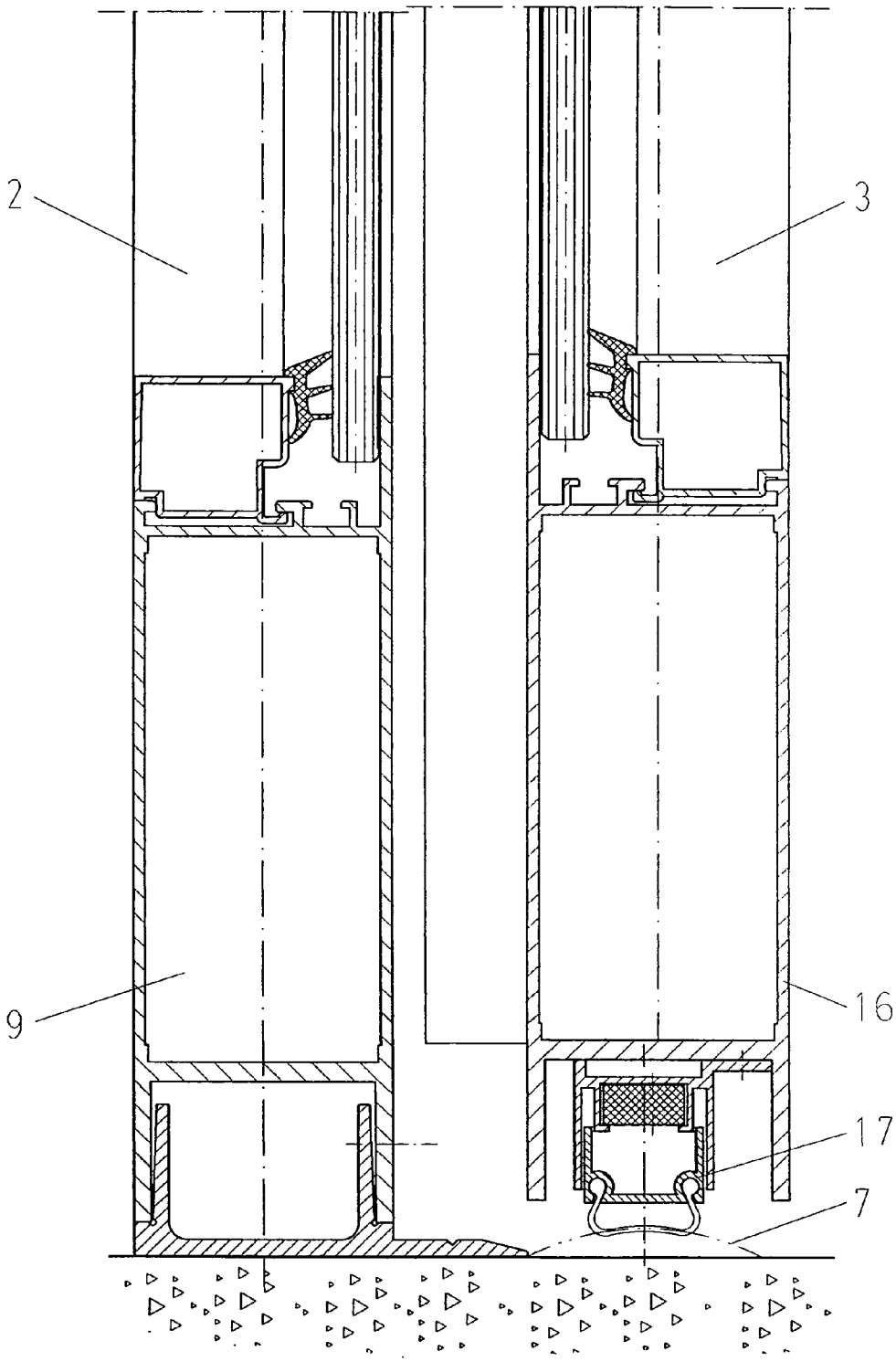
Fig. 8 X-X

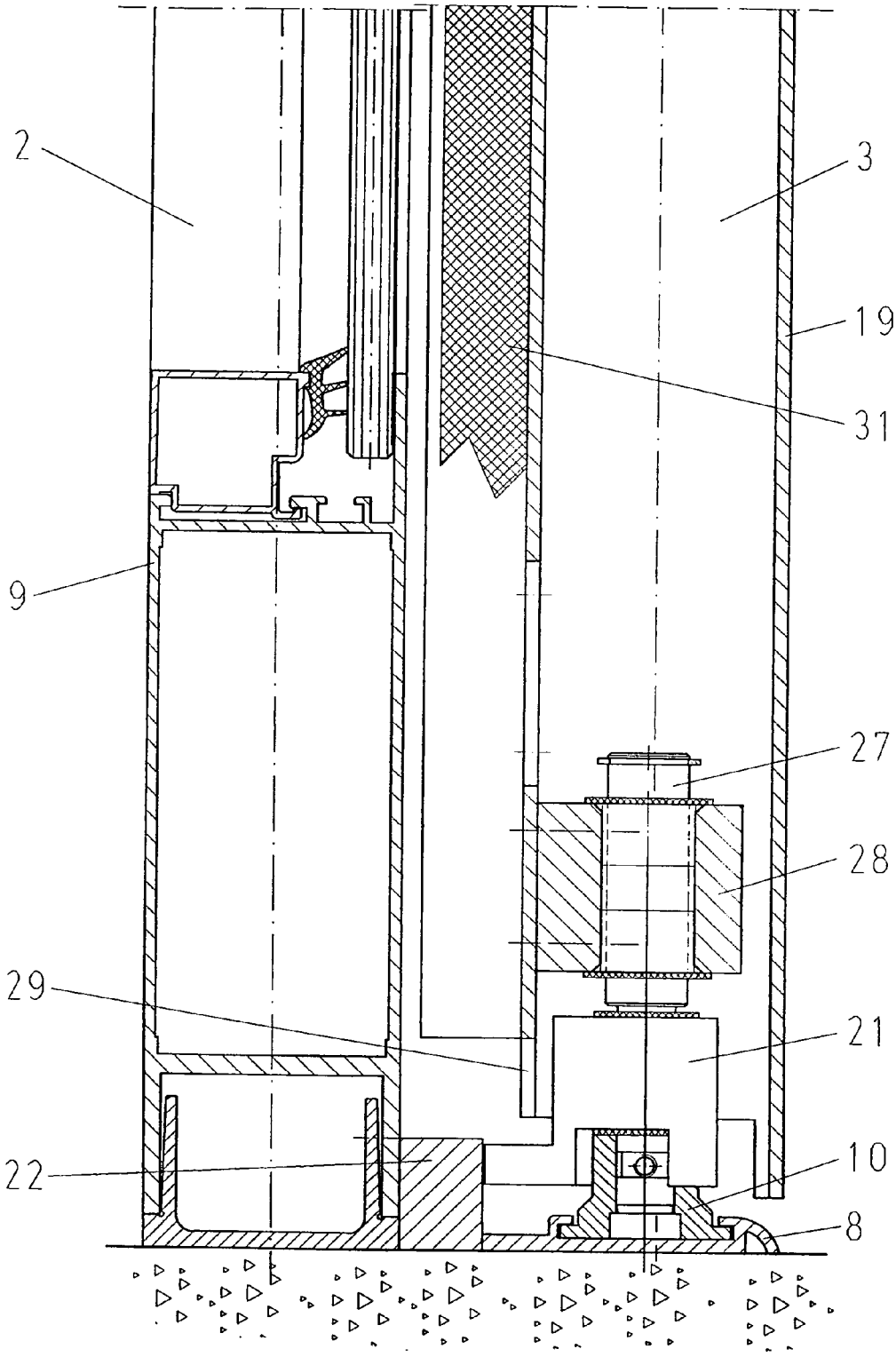
Fig. 9 Y-Y

SLIDING DOOR SYSTEM

BACKGROUND OF THE INVENTION

Field of the Invention

The invention pertains to a sliding door system with at least one automatically driven sliding sash guided on a traveling carriage.

These types of sliding door systems and their sliding leafs are opened and closed by an electric drive and a corresponding control unit. These types of sliding door systems are often used to produce a leak-proof seal for interior spaces and therefore must be provided with effective sealing measures in the area of their contact edges and at other points where leakage is likely to occur. In the case of fire, the escape of smoke must be effectively and reliably prevented. When such systems are used in escape and rescue routes, furthermore, the sliding leafs and possibly their side parts can be pivoted around a vertical axis of rotation and thus opened in the escape direction when a panic situation occurs.

A sliding door system of this type is known from DE 197 53 132 A1, where expanding fire protection material is used to seal off several intermediate spaces located between the sliding leafs and the surrounding periphery. The disadvantage here is that the fire protection material is not activated until the temperature has been raised sufficiently by the fire. The only way to prevent the leakage of smoke before that point is reached, however, is by the use of additional measures, involving the use of sealing devices which are activated when a sensor-measured threshold value is exceeded.

It is also known that, when in their closed position, the sliding leafs of door systems can be sealed against the floor by lowerable sealing strips. A sealing device of this type is described in, for example, DE 35 26 720 C2. The disadvantage here is that the release device projects from the main contact edge of the sliding leaf but is not protected in any way.

SUMMARY OF THE INVENTION

An object of the present invention is to provide a sliding door system which guarantees a reliable and effective sealing function especially against smoke and fire, and which is also suitable for use in escape and rescue routes. A sliding door system of this type should also be usable anywhere, regardless of the type of structure in question.

The sliding door system of the present invention is a door system which is always sealed when in the closed state, because the sliding leafs always provide a complete seal regardless of the boundary conditions such as smoke or fire. When smoke or fire occurs, there is no need to activate any additional sealing devices of any kind, which means that there is no need for any sensor-activated devices to create a smoke-tight seal. As a result of the continuous sealing function, the sliding door system is also suitable for use in situations where good sound damping or thermal insulation is also required and also in situations where nearly dust-free areas are to be created. As an option, the sliding door system according to the present invention can also have stationary side parts which can be designed to swing open in case of need. The overall design of the system is such that the sliding doors can be used in any type of structure and adapted to the prevailing construction tolerances.

The actuation or automatic drive of the sliding leafs can be adapted to various closing forces, which vary as a function of the number and type of sealing measures required in the specific case. A smoke alarm system can also be provided, so that the sliding leafs can be closed by a motor when an alarm is given and then locked so that they can no longer be opened in the sliding direction. The locking function can make use of the standard locking mechanism of the sliding door system, which holds the traveling carriages of the sliding leafs in place.

A sealing strip is integrated invisibly into the transverse profile at the bottom of the sliding leaf and lowered automatically onto the floor to form a seal when the door system is closed. A release device for the spring-loaded sealing strip is actuated by a rotatably supported cam located in the longitudinal profile at the secondary contact edge of the sliding leaf. This cam is turned by a stationary ramp when the sliding leaf moves in the closing direction. That the components which control and release the sealing strip are located within the frame at the secondary contact edge means that they are shifted into a protected area. No parts of any kind project into the room, where they could possibly be damaged or manipulated by passers-by. Because of the way in which the ramp and the cam interact according to the invention to release the sealing strip, the actuating force increases continuously, which is advantageous especially with respect to control, because this prevents the door from being a slow-moving hazard.

Because the release device and the cam are mounted permanently in the frame of the sliding leaf and are thus aligned precisely with each other, they never need to be readjusted. The cam, the axle body of the cam, and a floor glide on the bottom form a compact assembly. The cam has a projecting lobe, which slides along the ramp. On the radially opposite side of the cam there is a slide block, which actuates the release device. At least one axially projecting stop at the bottom of the slide block prevents the cam from turning too far. It is advantageous to fabricate the cam out of aluminum, because this reduces wear, especially on the contact surfaces. The cam and the floor glide are accessible through openings in the longitudinal profile of the sliding leaf, so that they can be replaced or so that the height of the components can be adjusted.

When the door is opened, no additional force component is required to retract the sealing strip, because the sealing strip's own elastic restoring force fulfills this function. The release device also presses the cam back into the starting position. The cam is supported rotatably on the axle body; when the sliding leaf is swung open to open an escape route, the release device therefore travels by a rotational movement around the slide block of the cam, which remains in its position, with the result that the release device is automatically pulled back and the sealing strip rises from the floor. The friction and wear which occur during the pivoting of the sliding leaf are therefore reduced. It is advantageous for the sliding leaf to be swung into its closed position by a door closer, which is installed under cover at the top, inside the frame. Here again, the slide block of the cam actuates the release device to lower the sealing strip back onto the floor. It follows from this that the swinging of the sliding leaf does not interfere with the functions of the cam and the release device either during or after the swinging open or swinging closed of the sliding leaf.

The runway rail which guides the sliding leaf along the floor and the ramp which controls the cam are screwed permanently to the attachment of the side part to the floor, which guarantees their precise alignment with the cam and the reliable operation of the release function. As a result, the sliding leaf is also guided precisely across a vertical seal located on the side part. In an advantageous embodiment, the runway rail and a threshold, onto which the sealing strip is lowered, can be designed as a one-piece profile.

The functional area pertaining to the release of the bottom sealing strip is completely outside the vertical sealing plane. The vertical sealing at the secondary contact edge between the stationary side part and the sliding leaf is advantageously provided by an elastic sealing profile. The sealing profile has the shape of a lip to minimize the force required to actuate the seal and thus to minimize the load on the drive. That the motion occurs along a wedge-shaped vertical profile has the effect of reducing the load.

Sealing profiles with sealing lips are mounted on the main contact edge; even in the case of a door system with two leafs, these profiles and lips ensure a good seal after the sliding leafs have been swung shut. Here, too, the actuating force to be provided by the drive is minimized.

The door system is also sealed adequately along the top horizontal edges. An automatically actuated sealing strip between the drive housing and the support profile of the sliding leaf provides the seal. This sealing strip is designed basically in the same way as the bottom sealing strip and is integrated into the housing. Slots are provided so that its position with respect to the support profile can be adjusted. The sealing strip is operated by way of a force-reducing lever mechanism, which is actuated by an arm mounted on the support profile. The arm has a plastic end piece, which can be adjusted in several directions and which is designed so that it can be mounted on or under the arm, depending on the preset height of the sliding leaf.

The housing is sealed off horizontally with respect to the ceiling by an extendable ceiling cover profile and possibly also by silicone. Lining panels, which can be extended toward the wall, are also mounted on the edge areas of the vertical columns. These panels can also be sealed with silicone if desired. The leakage points at the corners and transition areas are sealed by brush seals or by molded plastic parts.

BRIEF DESCRIPTION OF THE DRAWINGS

FIG. 8 is a partial longitudinal cross-sectional view through the sliding door system along axis VIII—VIII of FIG. 3;

FIG. 9 is a partial longitudinal cross-sectional view through the sliding door system along axis IX—IX of FIG. 5;

Although the invention is explained and described in the following in the form of a sliding door system with a smoke protection function, it can also be put into service wherever a tightly-sealing door system is used.

DETAILED DESCRIPTION OF THE PREFERRED EMBODIMENTS

Figure 1:
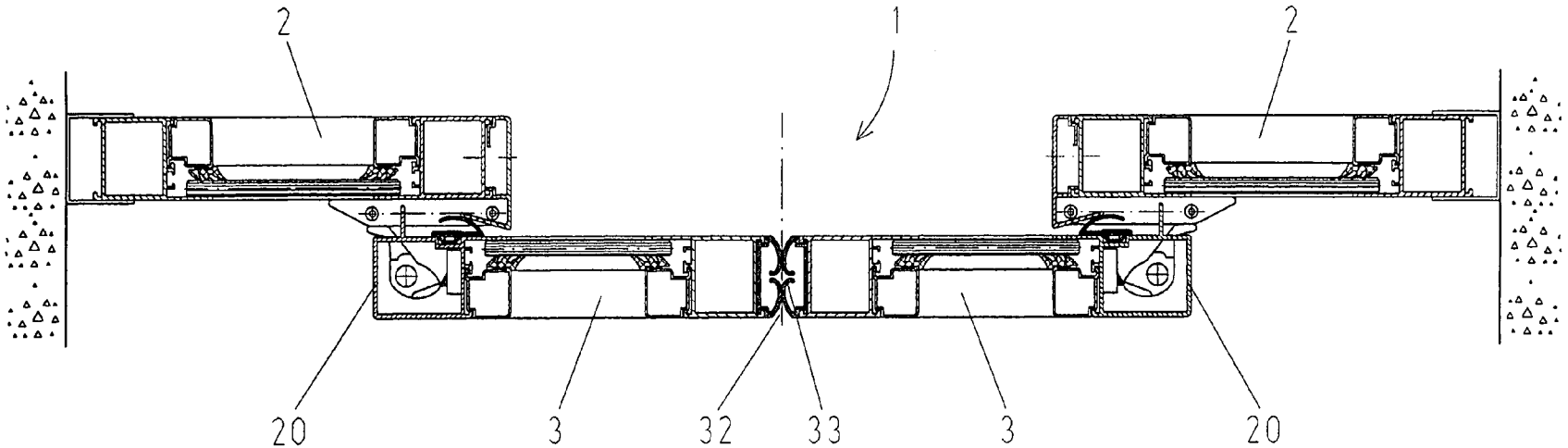
FIG. 1 is a cross-sectional view in plan, of a sliding door system with side parts and sliding leafs in the closed state.
Figure 2:
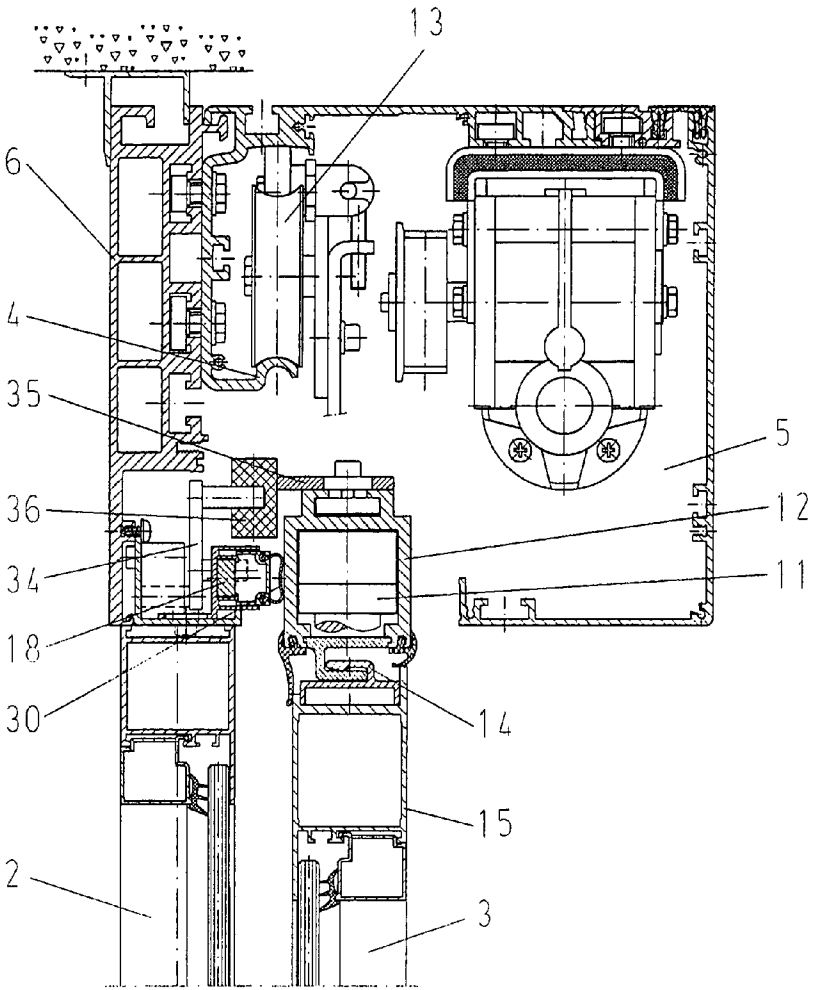
FIG. 2 is a partial longitudinal cross-sectional view of a sliding door system according to FIG. 1.

In FIGS. 1 and 2, the illustrated sliding door system 1 consists of two stationary side parts 2 and two sliding leafs 3, which are guided so that they can slide back and forth between the side parts. Steel columns 50 (illustrated generically) are installed at the sides of an opening in a building. These columns extend between the floor and the ceiling, and a runway rail 4 and a housing 6, which supports a drive 5, are attached to them. The side parts 2 are attached laterally to the steel columns 50 and also, at the top, to the housing 6. In FIGS. 8 and 9, a door threshold 7 and rails 8, which serve to guide the sliding leafs 3 along the floor, are permanently connected to the floor, and are preferably also connected to the frame 9 of the side parts 2. Floor glides 10 on the sliding leafs 3 are attached in a form-locking manner to the rails 8 and are free to slide along them.

Referring to FIG. 2, each sliding leaf 3 is attached pivotably to its own support profile 12 by an adjustable support arm 11. The support profile 12 is connected in turn to a carriage 13, which travels along the runway rail 4. The sliding leaf 3 is kept in the normal position with respect to the support section 12 by interlocking profiles 14. When a panic situation occurs, these profiles are disconnected from each other, and the sliding leafs 3 are swung out of their normal position in the escape direction. Door closers (not shown) are installed under cover in the upper horizontal transverse profile 15 of the sliding leafs 3. These door closers have slide rail arms, which are connected to slide pieces in the support profile 12 above, which is open at the bottom. The closers make it possible for the leafs to swing back automatically into the normal position.

Figure 2A:
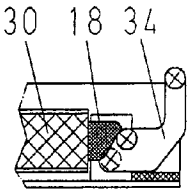
FIG. 2*a* is an enlarged plan view of part of FIG. 2, in which a sealing strip and a lever are in a first position.
Figure 3:
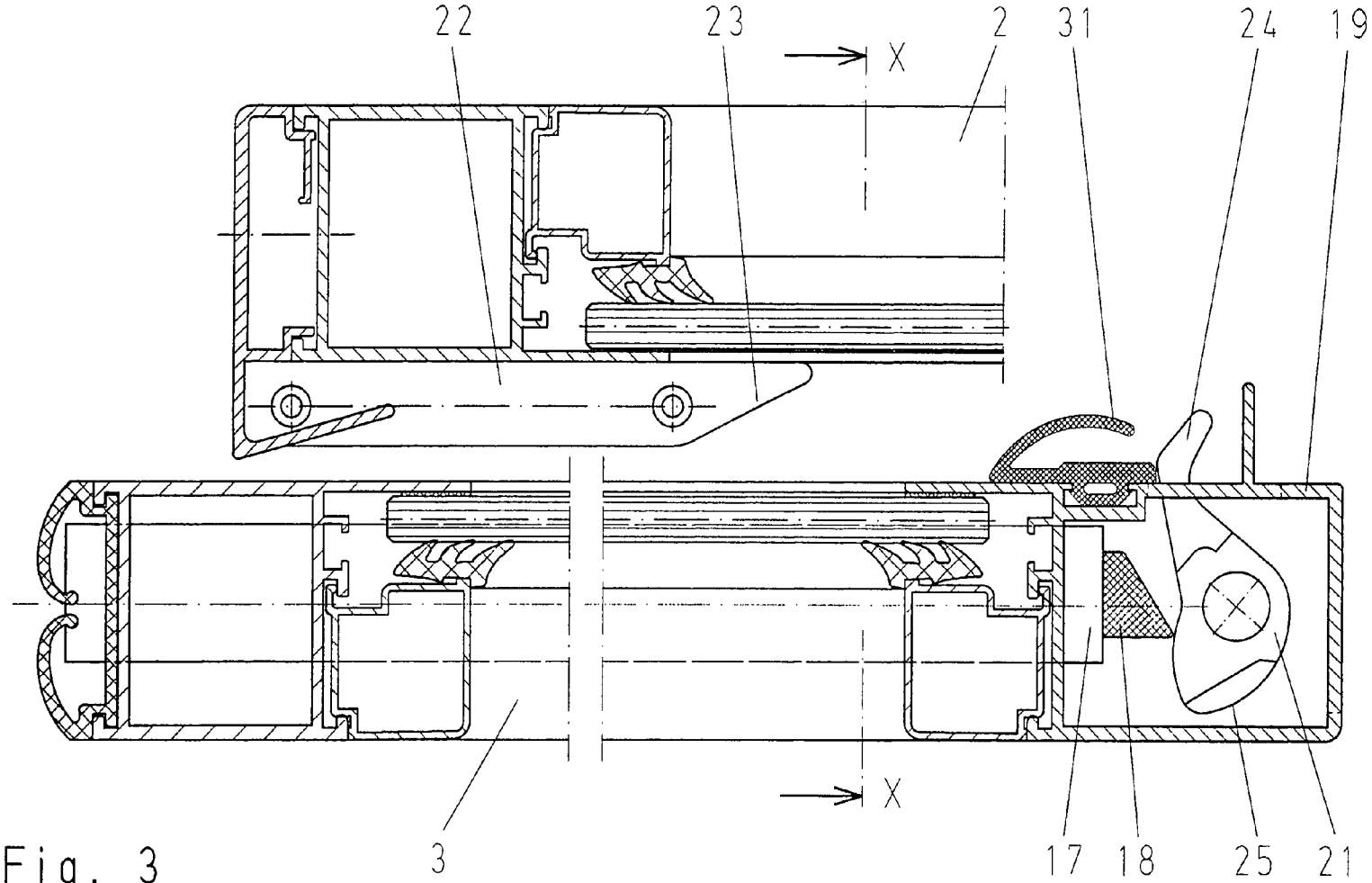
FIGS. 3–5 are enlarged partial cross-sectional views in plan of the sliding door system according to FIG. 1 in various stages of the closing operation.

In FIGS. 3 and 8, a spring-loaded sealing strip 17 is integrated invisibly into the transverse profile 16 at the bottom of each sliding leaf 3; when the door system 1 is closed, this strip is lowered automatically to the floor to form a seal. In FIGS. 2, 2*a* and 3, a release device 18 for the sealing strip 17 is actuated by a rotatably supported cam 21, which is located in a longitudinal profile 19 at the secondary sealing edge 20 of the sliding leaf 3. When the sliding leaf 3 travels in the closing direction, this cam 21 is turned by a ramp 22, which is attached permanently to the side part 2. The ramp 22 is preferably fabricated as an injection-molded part and has an entrance bevel 23.

Referring also to FIG. 10*a*–10*d*, the cam 21 has a projecting lobe 24. Opposite it, on the cam 21, a radially ascending slide block 25 extends over a certain area. A stop 26, which projects axially from the bottom of the slide block 25, prevents the cam 21 from rotating too far.

The release device 18 and the cam 21 are positioned precisely with respect to each other, because the two components are premounted at the factory in permanent positions in the transverse profile 16 and in the longitudinal profile 19, respectively, of the sliding leaf 3. The cam 21 an axle body 27 of the cam, and the floor glide 10 attached to the bottom of the axle body form a compact assembly, the axle body 27 being supported with freedom to slide in a bearing block 28 mounted inside the longitudinal profile 19. The assembly is accessible through openings 29 in the longitudinal profile 19 of the sliding leaf 3, so that the components can be replaced or so that their height can be adjusted.

Figure 4:
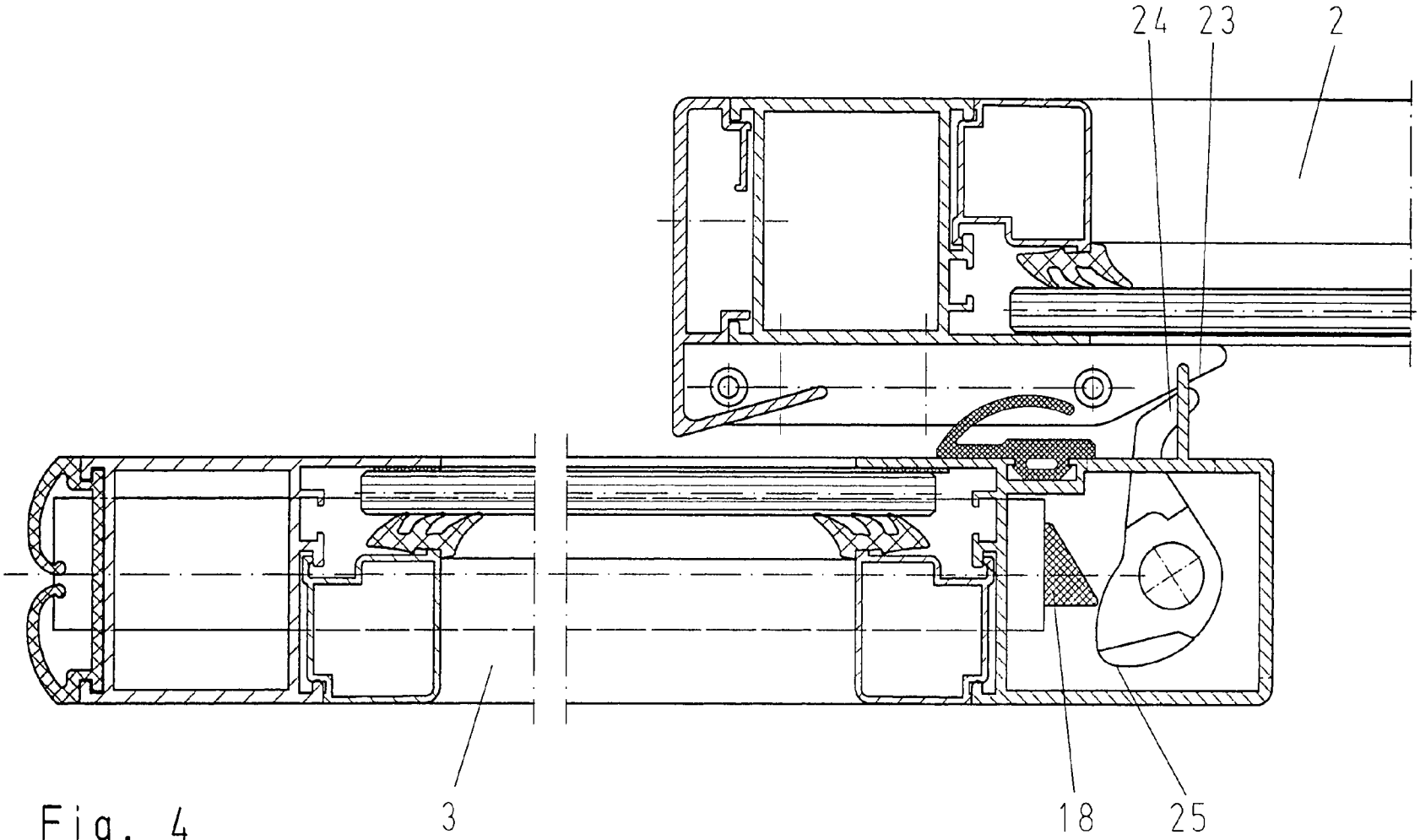
Figure 5:
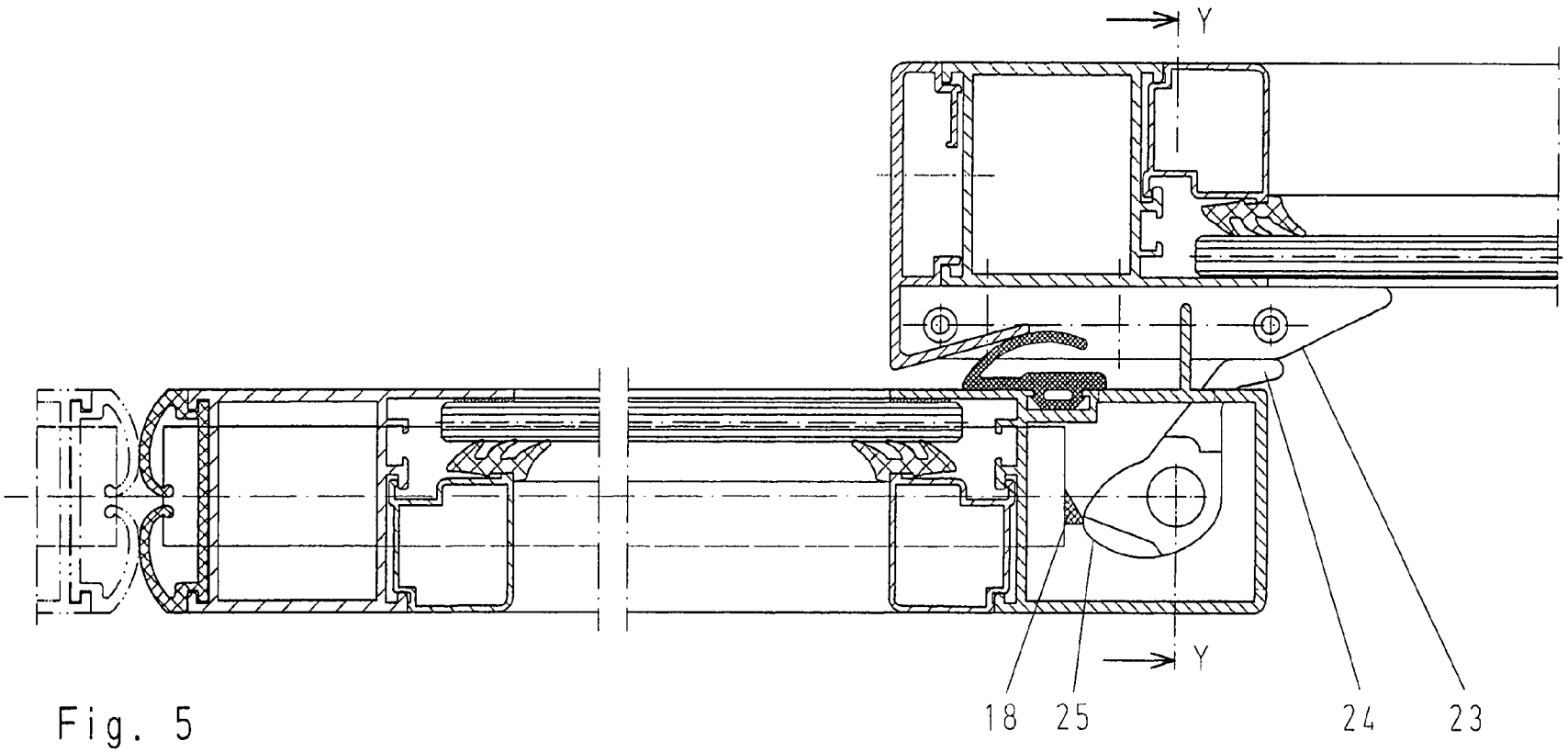

During a normal closing operation, the sliding leaf 3 is moved automatically by the drive 5. This operation starts from the completely open position shown in FIG. 3, in which the sealing strip 17 is completely retracted into the transverse profile 16 at the bottom of the leaf. During the closing operation, the lobe 24 of the cam 21 has a first phase of free travel before it starts to slide along the entrance bevel 23 of the ramp 22. As a result, the cam 21 is forced to turn, and the slide block 25 comes into contact with the release device 18 of the sealing strip 17 (see FIG. 4). As the closing movement of the sliding leaf 3 continues, the cam 21 continues to be turned by the ramp 22, so that the slide block 25 continues to press the release device 18 farther and farther inward (see FIG. 5), which has the effect of pushing the sealing strip 17 outward to a corresponding extent. By the time the leaf is completely closed, the sealing strip 17 is resting on the floor or on the threshold 7 to form a seal as shown in FIG. 8. All the other seals have also assumed effective positions by the time the sliding leaf 3 is closed. An additional horizontal sealing strip 30 between the housing 6 and the support profile 12 is also moved automatically into position.

During the normal door opening operation, no additional force component is required to retract the sealing strip 17, because the elastic restoring force of the sealing strip 17 fulfills this function. The release device 18 also presses the cam 21 back into its starting position.

Figure 6:
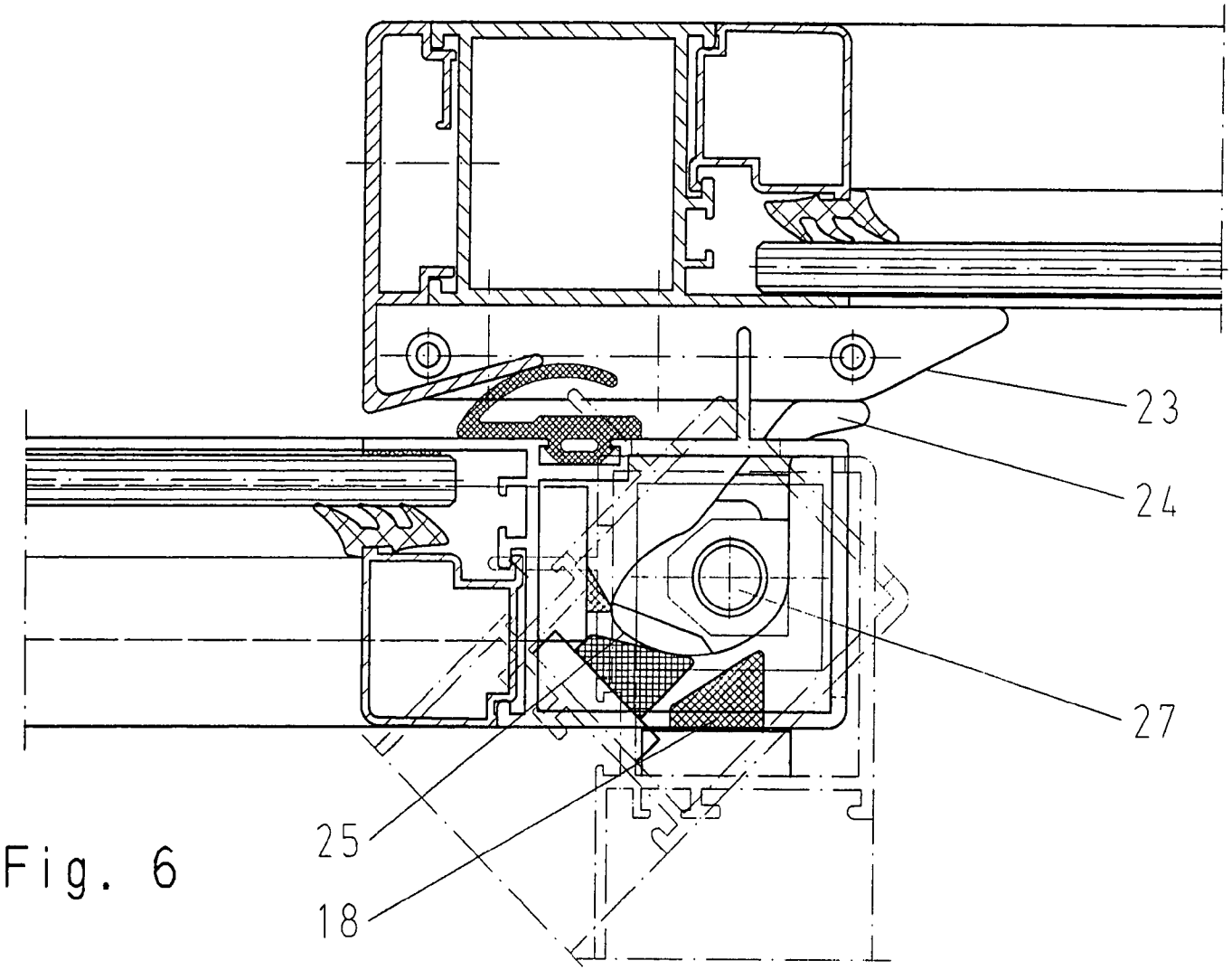
FIG. 6 is a partial cross-sectional view of the sliding door system according to FIG. 5 with the sliding leaf in various stages of the outward swinging movement, starting from the closed position.
Figure 7:
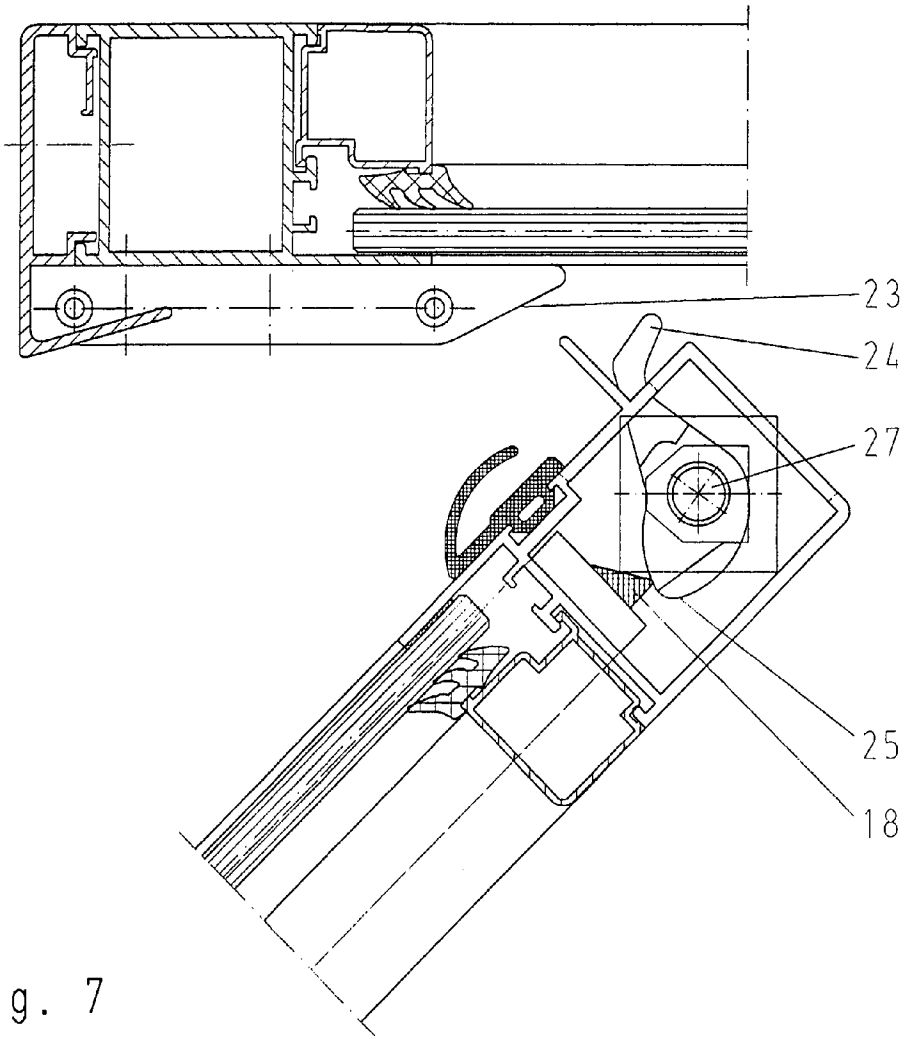
FIG. 7 is a partial cross-sectional view of the sliding door system according to FIG. 5, where the sliding leaf has been swung outward from the closed position.
Figures 10B, 10C, 10D:
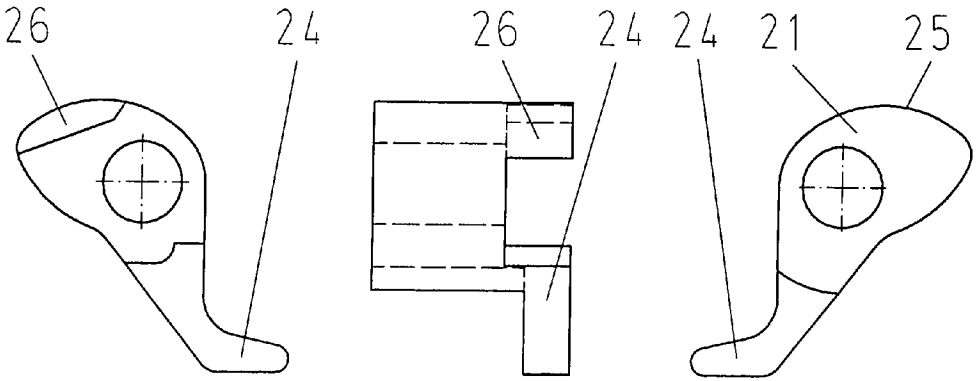
FIG. 10*b* is a bottom view of the cam of the sliding door system.
FIG. 10*c* is a side view of the cam of the sliding door system.
FIG. 10*d* is a plan view of the cam of the sliding door system.
Figure 10A:
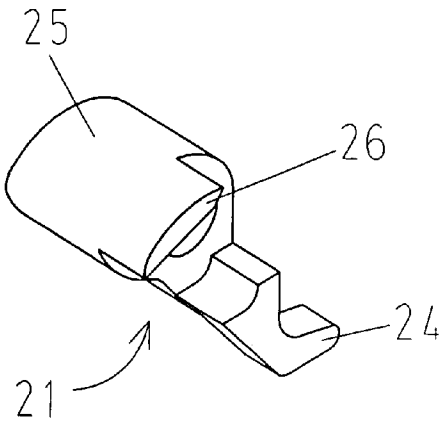
FIG. 10*a* is an isometric view of a cam of the sliding door system.
Figure 11A:
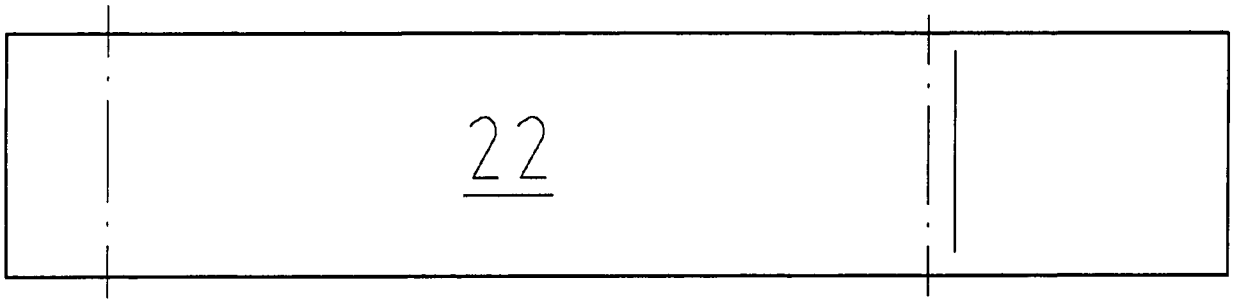
FIG. 11*a* is a side view of a ramp of the sliding door system.
Figure 11B:
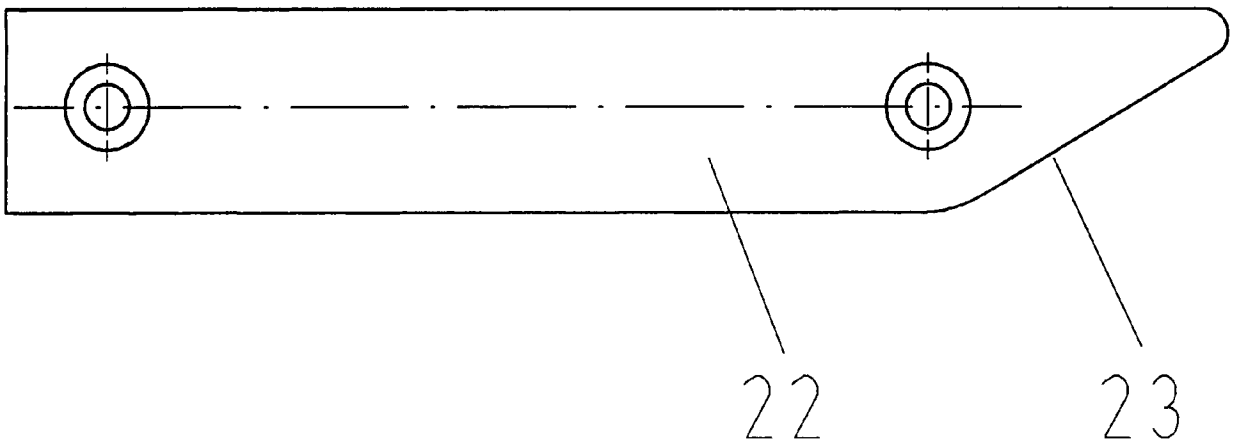
FIG. 11*b* is a plan view of the ramp of the sliding door system.

FIG. 6 shows that when the sliding leaf 3 is swung open in a panic situation, the release device travels rotationally around the slide block 25 of the cam 21, which is held in position against the ramp 22. The radially descending design of the slide block 25 makes it possible here for the spring-loaded release device 18 to travel outward, which has the effect of lifting the sealing strip 17 from the floor. The door closer takes care of swinging the sliding leaf 3 shut; during this phase , the slide block 25 of the cam 21 controls the movement of the release device 18, which now travels back in the opposite direction. It follows from this that there is no interference with the interaction between the cam 21 and the release device 18 either during or after the swinging-open or the swinging-closed of the sliding leaf 3.

The vertical seal along the secondary contact edge 20 between the stationary side part 2 and the sliding leaf 3 is advantageously accomplished by an elastic sealing profile 31, which is mounted on the sliding leaf 3. The sealing profile 31 has the shape of a lip to minimize the load on the drive 5. A load-reducing effect is obtained here in that the lip is supported by a wedge-shaped vertical profile (not shown in FIG. 3), which is mounted on the side part 2. For the sake of protecting the fingers, a web is also provided to guarantee a safety gap with respect to the side part 2.

As shown in FIG. 1, sealing profiles 33 with sealing lips are mounted on the central edge 32, i.e. axis, 32 of the sliding leafs 3. These profiles perform the desired sealing function after the sliding leafs 3 have been swung shut even in the case of a dual-leaf door system 1. Here again, the actuating force which the drive 5 must produce is minimized.

Figure 2B:
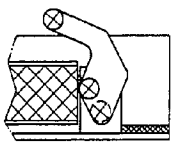
FIG. 2*b* is an enlarged plan view of part of FIG. 2, in which a sealing strip and a lever are in a second position.

The door system 1 is also adequately sealed along the top horizontal edges. An automatically actuated sealing strip 30 shown in FIGS. 2, 2*a*, 2*b* corresponds in its basic design to the sealing strip 17 at the bottom and is attached to the housing 6. The sealing strip 30 moves from the housing 6 toward the support profile 12 of the sliding leaf 3. An appropriate release device 18*a* is operated by a force-reducing lever 34, which is actuated by an arm 35 attached to the support profile 12, the arm having an end piece 36. The end piece 36 is designed so that it can be mounted on or under the arm 35, depending on the height at which the sliding leaf 3 is mounted. The way in which the sealing strip 30 operates is similar to that of the sealing strip 17 at the bottom. During the closing and opening of the sliding leaf 3, the movement of the sealing strip 30 is controlled by the arm 35, which is mounted on the support profile 12 and actuates the lever 34.

The horizontal sealing of the housing 5 against the ceiling is accomplished by extendable ceiling cover profiles (not shown) and possibly by silicone on the nonmoving parts. Extendable lining panels are also mounted on the edge areas of the vertical columns facing the wall, which panels are sealed with silicone if desired. The leakage points at the corners and transition areas are sealed by brush seals or molded plastic parts.

The preceding description of the exemplary embodiments according to the present invention serves only to illustrate the object of the invention, not to limit it. Within the scope of the invention, various changes and modifications can be made without abandoning the scope of either the invention itself or its equivalents.

LIST OF REFERENCE NUMBERS

1 sliding door system
2 side part
3 sliding leaf
4 runway rail
5 drive
6 housing
7 threshold
8 rail
9 frame
10 floor glide
11 support arm
12 support profile
13 carriage
14 profile
15 transverse profile
16 transverse profile
17 sealing strip
18 release device
19 longitudinal profile
20 secondary closing edge
21 cam
22 ramp
23 entrance bevel
24 lobe
25 slide block
26 stop
27 axle body
28 bearing block
29 opening
30 sealing strip

31 sealing profile
32 main closing edge
33 sealing profile
34 lever
35 arm
36 end piece

What is claimed is:

1. A sliding door system, comprising:

a housing including a drive and a runway rail;

an automatically driven sliding leaf having opposing horizontal edges and opposing vertical edges and connected to a traveling carriage by a support profile, said traveling carriage being movably mounted on said runway rail for movably supporting said sliding leaf, said drive being operatively connected for moving said traveling carriage along said runway rail for moving said sliding door between an open and a closed position, said sliding leaf also being pivotal about a vertical axis for pivoting open; and active sealing devices for producing seals along the opposing horizontal edges and the opposing vertical edges when the sliding leaf is in the closed position, wherein one of said sealing devices includes an automatically acting sealing strip mounted on a bottom of said sliding leaf, said automatically acting sealing strip being releasable from a sealing position by interaction with a release mechanism at one end of a transverse profile connected at the bottom of said sliding leaf, said release mechanism including a cam which actuates a release device of said sealing strip when said sliding leaf is moved out of the closed position, said cam having a side block and being rotatably supported on an axle body mounted in a longitudinal profile of said sliding leaf so that said release device travels rotationally around said side block of said cam and actuates said release device when the sliding leaf is pivoted open about the vertical axis.

2. The sliding door system of claim 1, wherein said automatically acting sealing strip comprises a lowerable sealing strip mounted in said transverse profile.

3. The sliding door system of claim 1, wherein said slide block has an area which ascends or descends in the radial direction.

4. The sliding door system of claim 1, wherein said cam includes stops.

5. The sliding door system of claim 1, wherein said cam has a projecting lobe.

6. The sliding door system of claim 1, further comprising a ramp permanently mounted on one of a side part of the sliding door system and a stationary wall, wherein said cam interacts with said ramp when said sliding leaf moves into said closed position.

7. The sliding door system of claim 6, wherein said ramp has an entrance bevel.

8. The sliding door system of claim 1, further comprising one of a threshold and a rail attached permanently to a stationary support.

9. The sliding door system of claim 8, wherein a bottom glide is attached to the axle body.

10. The sliding door system of claim 9, wherein said bottom glide is positively guided in said rail.

11. The sliding door system of claim 9, wherein said axle body, said bottom glide, and said cam form an assembly.

12. The sliding door system of claim 11, wherein said assembly is accessible via the longitudinal profile and is replaceable without removing said sliding leaf.

13. The sliding door system of claim 1, wherein said sealing devices includes a vertical sealing profile mounted on a secondary contact edge of said sliding leaf, said vertical sealing profile interacting with a profile attached to a stationary side part.

14. The sliding door system of claim 1, wherein said sealing devices include a vertical sealing profile with deflectable sealing lips mounted on a main closing edge of said sliding leaf.

15. The sliding door system of claim 1, wherein said sealing devices includes a sealing strip between said housing and said support profile with a cooperating lever supported on said housing, said lever interacts with an arm mounted on said support profile for actuating said sealing strip.

16. The sliding door system of claim 15, wherein said sealing strip is horizontally movable between said housing and said support profile in response to said lever.

17. The sliding door system of claim 1, wherein said sealing devices includes a first vertical sealing profile mounted on a secondary contact edge of said sliding leaf, said vertical sealing profile interacting with a profile attached to a stationary side part.

18. The sliding door system of claim 17, wherein said sealing devices include a second vertical sealing profile with deflectable sealing lips mounted on a main closing edge of said sliding leaf.

19. The sliding door system of claim 18, wherein said sealing devices includes a sealing strip between said housing and said support profile with a cooperating lever supported on said housing, said lever interacts with an arm mounted on said support profile for actuating said sealing strip.

* * * * *